United States Patent [19]

Lusch

[11] 3,947,069

[45] Mar. 30, 1976

[54] ADJUSTABLE DECK-CHAIR

[76] Inventor: Ferdinand Lusch, Hochstr. 9, 4814 Senne I near Bielefeld, Germany

[22] Filed: Jan. 21, 1974

[21] Appl. No.: 435,056

[52] U.S. Cl. ..... 297/317; 297/29; 297/341

[51] Int. Cl.[2] ..... A47C 1/02

[58] Field of Search ..... 297/316, 317, 318, 320, 297/321, 341, 19, 29, 311

[56] References Cited

UNITED STATES PATENTS

| | | | |
|---|---|---|---|
| 141,318 | 7/1873 | Buchanan | 297/317 |
| 226,475 | 4/1880 | Bell | 297/317 |
| 2,303,308 | 11/1942 | McArthur | 297/317 |
| 2,616,483 | 11/1952 | Jenson | 297/316 X |
| 2,617,471 | 11/1952 | Lorenz | 297/321 X |
| 2,633,181 | 3/1953 | Bell | 297/317 |
| 2,633,895 | 4/1953 | Battles | 297/318 |
| 2,656,878 | 10/1953 | Reinholz | 297/317 X |
| 3,142,512 | 7/1964 | Hamilton et al. | 297/317 |
| 3,773,383 | 11/1973 | Ekornes | 297/320 |

FOREIGN PATENTS OR APPLICATIONS

| | | | |
|---|---|---|---|
| 728,935 | 12/1942 | Germany | 297/316 |
| 503,766 | 4/1939 | United Kingdom | 297/317 |
| 300,872 | 11/1954 | Switzerland | 297/320 |

*Primary Examiner*—James T. McCall
*Attorney, Agent, or Firm*—Michael J. Striker

[57] ABSTRACT

An adjustable deck-chair comprises a frame having two lateral frame portions interconnected by a cross-bar. A seat-back assembly is pivotably supported by the lateral portions of the frame and is movable between an upright position in which the back is substantially perpendicular to the seat and a reclined position in which the seat and the back enclose an angle approximating 180°. The seat-back assembly is arrested in the upright position by a force exerted on the seat by a friction and detent member which is pivotably supported on the cross-bar and frictionally and wedgingly engages a portion of the seat frame. The lateral portions of the frame may be collapsible.

19 Claims, 18 Drawing Figures

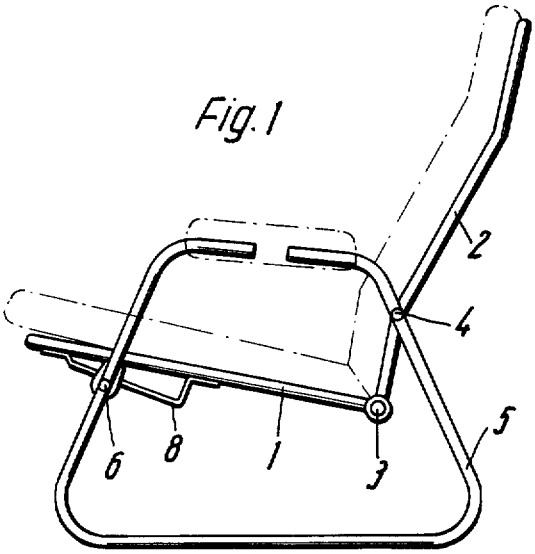
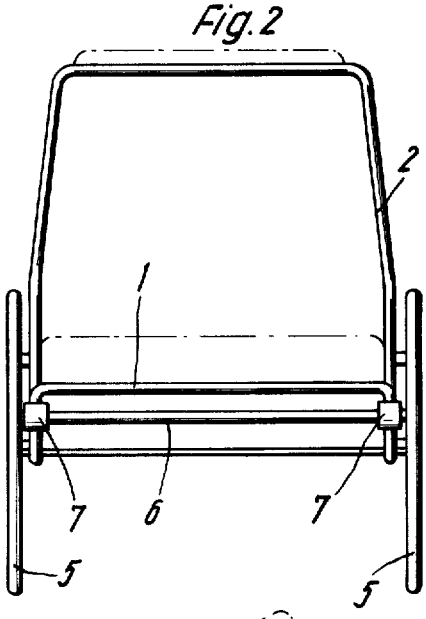
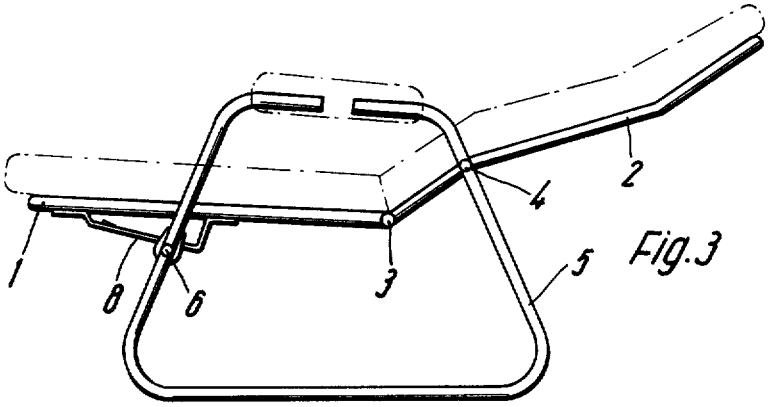
Fig.3
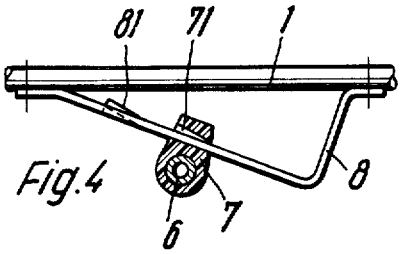
Fig.4
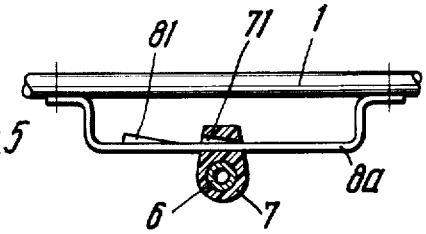
Fig.5
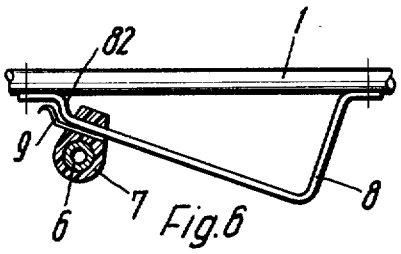
Fig.6
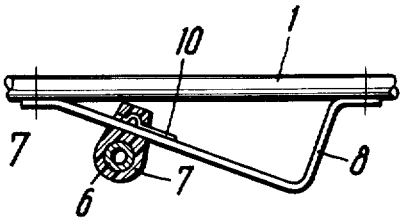
Fig.7

Fig. 14
Fig. 15
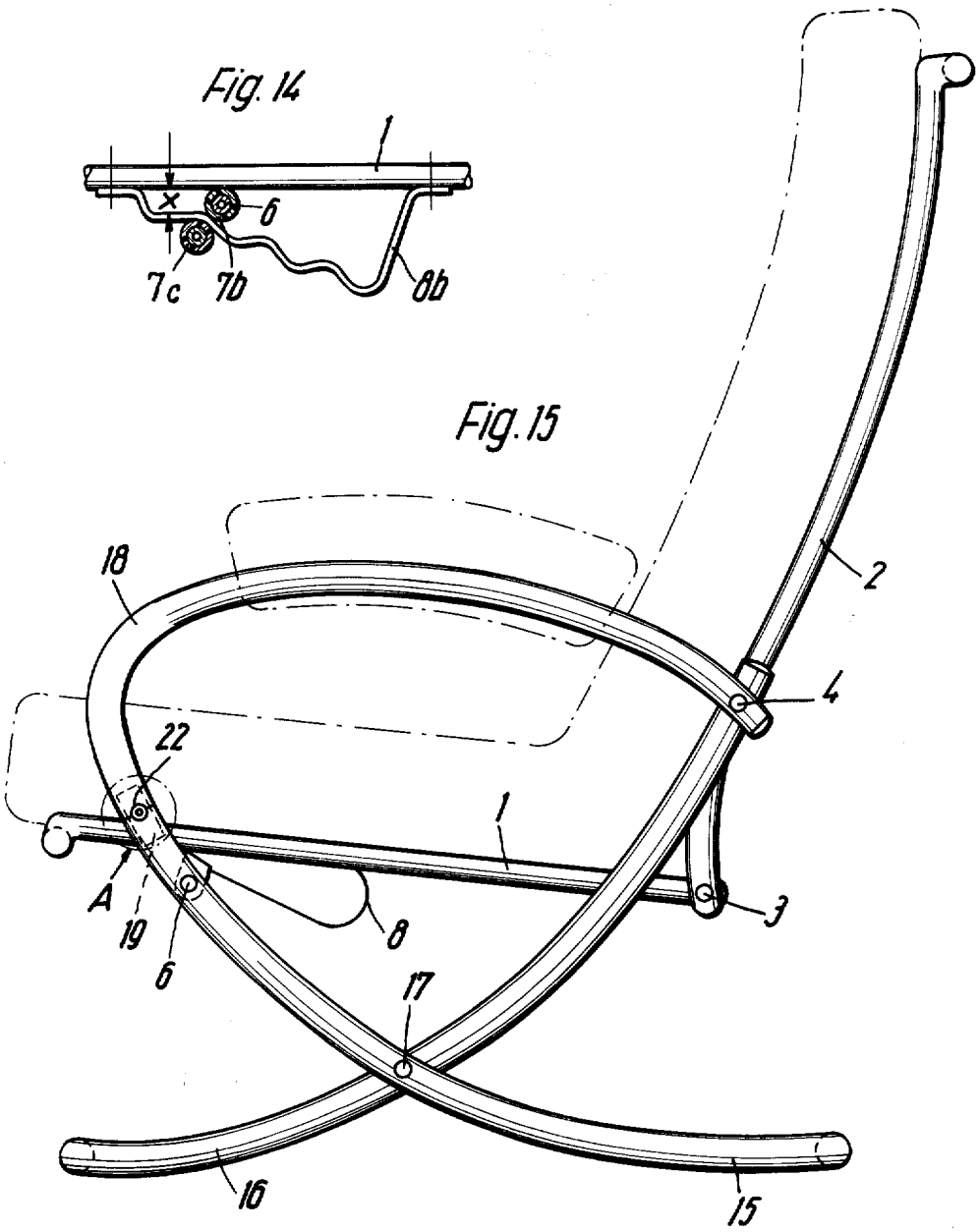
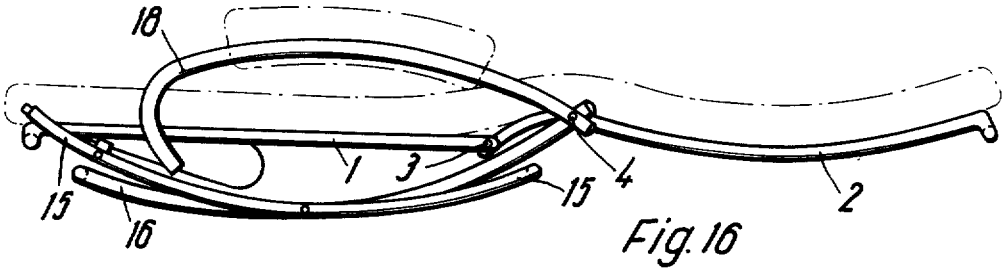
Fig. 16

ADJUSTABLE DECK-CHAIR

BACKGROUND OF THE INVENTION

The present invention relates to deck-chairs in general, and particularly to deck-chairs which are gradually adjustable to assume any selected position between an upright position in which the back is substantially perpendicular to the seat of the deck-chair, and a reclined position in which the seat and the back enclose an angle of approximately 180°. Even more particularly, the present invention relates to a deck-chair whose seat-back assembly is arrestable in the upright position.

There are already known various constructions of gradually adjustable deck-chairs which render possible the adjustment and arrest of the seat-back assembly in any desired position between the upright position and the reclined position thereof. The purpose of this construction is to permit utilization of the deck-chair both as a chair and as a cot. However, all of these constructions require utilization of relatively complex frames and associated adjusting and arresting mechanisms, so that the overall construction of such deck-chair is complicated and the manufacturing cost thereof substantial, which is then reflected in the price of such a deck-chair. If the price of such a deck-chair is to be held in reasonable bounds, the manufacture thereof is economical only if large quantities of such deck-chairs are produced in assembly-line production. On the other hand, the demand for such chairs is not so high as to warrant assembly-line production, and even if the latter is used, there are encountered problems with available storage space.

In addition to the above-discussed disadvantages of the conventional deck-chairs, the complexity of the adjusting and arresting mechanisms utilized in such chairs brings about various difficulties for the user of the chair, particularly if he is unskilled and unfamiliar with handling complex mechanisms. This, in turn, results in possibly dangerous conditions when the unskilled person improperly adjusts the adjusting and arresting mechanism, particularly the danger that the deck-chair may collapse while the user occupies the same. Moreover, the provision of relatively bulky and unsightly adjusting and arresting mechanisms impairs the appearance of the deck-chair, and the various projecting portions of such mechanisms may cause injury to the user of the deck-chair, particularly during the transport thereof from one location to another one.

SUMMARY OF THE INVENTION

Accordingly, it is an object of the present invention to avoid the disadvantages of the prior art devices.

More particularly, it is an object of the present invention to provide a deck-chair or a similar device which is simple in construction and reliable in operation It is still another object of the present invention to provide a deck-chair which may be easily adjusted and which permits gradual adjustment in any position of the seat-back assembly between an upright position thereof in which the back expends substantially perpendicularly to the seat and a reclined position in which the seat and the back are approximately in the same plane.

It is a concomitant object of the present invention to provide a simple and reliable adjusting and arresting mechanism to be used in a deck-chair for retaining the seat-back assembly thereof in any desired position.

It is a further object of the present invention to provide such adjusting and arresting mechanism which is simple to operate but reliable nevertheless.

It is yet another object of the present invention to provide a deck-chair in which the adjustment of the seat-back assembly may be accomplished by a simple transfer of the center of gravity of the occupier of the deck-chair.

It is a further object of the present invention to provide a deck-chair which assumes its upright position when the occupier leaves the same and is arrested in this position pending a volitional act of the occupier.

In pursuance of these objects and others which will become apparent hereinafter, one feature of the invention resides in providing a deck-chair which comprises a frame including two lateral frame portions which are interconnected by at least one cross-bar, and a seat-back assembly including a seat and a back which are pivotably connected to one another and being pivotably supported by the lateral portions of the frame so as to be movable between an upright position in which the back encloses substantially a right angle with the seat and a reclined position in which the seat and the back are located in approximately the same plane. A friction and detent member is pivotably supported on the cross-bar and engages portions of the frame of the seat so as to arrest the seat-back assembly in its upright position and to retard movement of the seat-back assembly between the upright and the reclined positions thereof.

In the currently preferred embodiments of the invention, the frame of the seat is provided with at least one bracket which cooperates with the friction and detent member in such a manner that when the seat-back assembly is being moved between the upright and the reclined position thereof, frictional force between the bracket and the friction and detent member results in retardation of this movement. In addition thereto, the bracket may be provided with a wedge member which engages the friction and detent member when the seat-back assembly is in its upright position, so that displacement of the seat-back assembly from the upright position into any other position requires a substantial, even though not excessive, force.

In the currently preferred embodiment of the invention, the friction and detent member is made of rubber or a similar rubber-elastic material, and is provided with a passage in which the bracket is partially accommodated.

A modified embodiment of the invention, which is particularly suitable if the deck-chair is to be often transported from one location to another, for instance in a car trunk or the like where the available space is limited and where it is important that the deck-chair be collapsible so as not to take an excessive space, the lateral portions of the frame are each composed of two parts which are connected together by means of a clamping device which permits dismounting of the connection and movement of the two parts of the lateral portions with respect to one another in such a way as to minimize the space taken up by the deck-chair. Preferably, the lateral frame portions are tubular and the clamping device is of the spreading type, that is a device which is inserted into the abutting end portions of the cooperating parts of the lateral frame portion and spread therein, so that the cooperating parts are held to one another by friction between the clamping member and the inner surfaces of the tubular end portions of the two cooperating and abutting parts of the lateral portion of the frame. Conversely, once the spreading force is discontinued, the two end portions of the parts of the lateral portions of the frame may be easily taken apart, and the deck-chair may be folded.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a side elevational view of a first embodiment of the deck-chair according to the invention in its upright position;

FIG. 2 is a front elevational view of the deck-chair of FIG. 1;

FIG. 3 is a side elevational view of the deck-chair of FIG. 1 in its reclined position;

FIGS. 4 to 14 illustrate, in partial cross-section, various embodiments of the adjusting and arresting mechanism which is used in the deck-chair of FIGS. 1 to 3, 15 and 16;

FIG. 15 is a side elevational view of a second embodiment of the deck-chair according to the invention in its upright position;

FIG. 16 is a side elevational view of the deck-chair of FIG. 15 in its folded position;

DETAILED DESCRIPTION OF THE PREFERRED EMBODIMENTS

Figure 8:
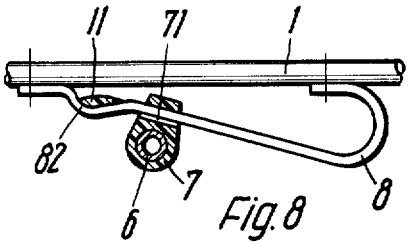

Discussing now the drawing in detail, and firstly FIGS. 1 to 3 thereof, it will be seen that these Figures give an overall view of a first embodiment of the deck-chair according to the invention. In this context, it is to be understood that while the invention is being described as applied in a deck-chair, it is not limited to this application but can be utilized in other kinds of reclining or convertible chairs, chaise longues or similar pieces of furniture or garden or pool accessories.

The illustrated embodiment of the invention comprises a seat 1 and a back 2 which are pivotably connected to one another by a pivot or pin 3 so as to form a seat-back unit. The seat 1 and the back 2 can either be of unitary construction, such as plates of wood, plywood or synthetic plastic material or, as illustrated in the drawing, comprise a rigid supporting structure or frame and have a system of interwoven straps, a piece of cloth or felt connected to the supporting structure and spanning the space therebetween; all these expedients are well known in the art and do not necessitate further elaboration. In the currently preferred embodiment of the invention, a cushion is placed on the seat-back assembly, this cushion being shown in dash-dotted lines. If so desired, this cushion can be attached to the supporting structure by conventional attachment means.

The seat-back assembly 1 to 3 is pivotably supported on a frame which, in the embodiment illustrated in FIGS. 1 to 3, comprises two lateral portions 5 which are rigidly connected to one another at least by means of a cross-bar 6 so that the two lateral portions 5 and the cross-bar 6 form a rigid frame. A pivot 4 connects the back 2 to the two lateral portions 5 of the frame. There may either be provided two pivots 4, each of which pivotably connects the back 2 to one of the lateral portions 5 of the frame, or there may be provided only one pivot extending between the two lateral portions 5 and rigidly attached thereto, which expedient affords the frame increased stability. In the latter case, the back 2 is pivotably supported on the through pivot and is free to rotate with respect thereto.

The seat 1, in addition to being connected to the back 2, is also supported on the cross-bar 6 in a manner which will be described later on when discussing the other Figures; for the present purposes it is sufficient to point out that the seat 1 is free to move in the forward and rearward direction of the deck-chair and to tilt within a limited range with respect to the cross-bar 6. FIG. 1 shows the deck-chair in its upright position, that is the position assumed when the occupant desires to use the deck-chair as a chair, while FIG. 3 shows the same deck-chair in its reclined position, that is a position which it assumes when used as a cot, a bed or the like. The seat-back assembly 1 to 3 may be freely moved between these two positions by a simple expedient of shifting the center of gravity of the occupant or by his bracing his feet against the ground. When the seat-back assembly is to be moved from its upright into its reclined position, the center of gravity is shifted rearwardly, so that a force is applied to the back 2 forcing the same to move in the clockwise direction as shown in the drawings. As a result of this movement of the back 2, the seat 1 is pushed in the forward direction —in the drawings toward the left—, with simultaneous lifting of the rear end of the seat 1. The seat-back assembly may be stopped in any desired position beyond the upright position, and will remain in this selected position as a result of friction as will be described later on. If the center of gravity is shifted again to a sufficient extent to overcome the friction, the seat-back assembly may be moved to any other desired position, including the upright and fully reclined positions.

The lateral portions 5 of the frame of the currently preferred embodiment of the deck-chair as illustrated in FIGS. 1 to 3 are of tubular material which is bent so as to provide the desired profile. The lateral portions 5 may be provided with, and interconnected by, a conventional arm rest which is shown in dash-dotted lines.

The deck-chair is provided with an adjusting and arresting mechanism which will now be described in detail with reference to FIGS. 4 to 14 which illustrate various embodiments of the mechanism. For the sake of clarity, the same or corresponding parts of the mechanism have been assigned the same reference numerals throughout. The adjusting and arresting mechanism includes a friction and detent member 7 which is freely rotatably supported on the cross-bar 6 and which may be made of natural or synthetic rubber or other natural or synthetic plastic material. What is important is that the material of the friction and detent member have pronounced frictional properties and be elastically yieldable to at least some extent. Such materials are well known in the art.

The friction and detent member 7 cooperates with a bracket 8 which is attached to the seat 1 by any suitable attachment means, such as screws, bolts, welding, soldering and so on, and possibly also with the structure of the seat 1 itself. The mode of cooperation will be discussed in connection with the various embodiments of the friction and detent mechanism; it is only to be pointed out that in the embodiments illustrated in FIGS. 4 to 13, the bracket 8 extends through a passage 71 provided in the friction and detent member 7.

The brackets 8 which are illustrated in FIGS. 1, 3, 4 and 6 to 14 are so configurated that the distance between the seat 1 and the bracket 8 increases in the rearward direction of the deck-chair, that is toward the right as shown in the drawings. In other words, the operative portion of the bracket 8 encloses an acute angle with the seat 1, so that the distance between the corresponding portions of the seat 1 on one hand and the bracket 8 on the other hand increases in the rearward direction. Thus, when the seat-back assembly is moved from its upright position toward the fully reclined position thereof, not only does the seat 1 move forwardly, but the portion thereof which is supported on the cross-bar 6 via the friction and detent member 7 and the bracket 8 is also lifted. This, of course, is in addition to the lifting of the rear end of the seat 1 which results from the circular motion of the pivots 3 about the pivot or pivots 4. As a result of this expedient, the seat 1 is slightly inclined downwardly and rearwardly when the seat-back assembly is in its upright position, while, when the seat-back assembly assumes its fully reclined position, at least the seat 1 extends substantially horizontally. Of course, in all these explanations, it is assumed that the deck-chair is situated on a level ground so that the lower portions of the lateral portions 5 of the frame (FIGS. 1 to 3) and the cross-bar 6 extend substantially horizontally which, incidentally, is the suggested position in which the deck-chair is to be utilized. The advantage of this arrangement is that it affords the occupier a comfortable accommodation in both the upright and the fully reclined positions and also in any intermediate position.

Contrarily thereto, the embodiment illustrated in FIG. 5 includes a bracket 8 whose operative portion extends in parallel to the seat 1. If the same advantages as in the previous embodiments are to be achieved, the pivot 4 has to be located at substantially the same level as the cross-bar 6. In this embodiment, the front portion of the seat 1 only slides with respect to the cross-bar 6 without being lifted with respect thereto, while the rear part is being lifted due to the fact that the pivot 3 conducts circular movement about the pivot 4 as the seat-back assembly is being moved towards the fully reclined position thereof.

Advantageously, in all of the above-mentioned embodiments, the seat-back assembly, when in its fully reclined position, assumes a horizontal plane, or at least substantially so.

As already mentioned, the bracket 8 is accommodated in the passage 71 of the friction and detent member 7. At least when the deck-chair is being occupied, there exists a frictional force between the bracket 8 and the surfaces delimiting the passage 71 of the friction and detent member 7, the magnitude of the frictional force being directly proportional to the force with which the bracket 8 is pressed against the afore-mentioned surfaces of the member 7. The frictional force is of such a magnitude as to prevent unintentional movement of the seat-back assembly, but also sufficiently small as to be easily overcome when the occupier purposely transfers his center of gravity with the intention to change the position of the seat-back assembly. As a result of this, the frictional force retains the seat-back assembly in any selected position until the occupier decides to change the position thereof.

When the occupier of the deck-chair decides to leave the same, he has to move the center of gravity of his body forwardly, which results in an automatic movement of the seat-back assembly into the upright position, that is the seat 1 moves rearwardly and the back 2 in the counterclockwise direction. In order that, after the occupier has left the seat, the seat-back assembly does not assume any other than the upright position thereof, there are provided means for retention of the seat-back assembly in its upright position, which means will now be described with reference to the various embodiments of the adjusting and arresting mechanism as illustrated in the various Figures.

In the embodiments illustrated in FIGS. 4 and 5, the brackets 8 are preferably made of flat steel strips, and they are provided with tongues 81 which are bent out of the plane of the operative portion of the bracket 8, the operative portion in this and other embodiments being that portion which cooperates with the surfaces of the member 7 which define the passage 71 therein. The tongues 81 are preferably partially punched out of the strip-shaped bracket 8 and form a wedge. Advantageously, the passage 71 has a corresponding wedge-shaped configuration. When the occupier is in the act of leaving the deck-chair and standing up, the center of gravity of his body moves in the forward direction which results in rearward movement of the seat 1 —that is to the right in the drawings—, until the seat-back assembly assumes the upright position thereof. As a result of this movement, the tongues 81 of the brackets 8 enter the wedge-shaped passages 71 of the friction and detent member 7, and the material of the member 7 and/or the tongues 71 are elastically deformed to such an extent that the bracket 8 is arrested in this position by friction between the surfaces thereof and the tongues 81 and the surfaces bounding the passage 71 of the member 7. Once the deck-chair is again occupied, this frictional force may be volitionally and intentionally overcome by transferring the center of gravity of the body of the occupier. It is evident that this retention of the seat-back assembly in the upright position thereof can also be obtained by other means. So, for instance, in the embodiment illustrated in FIG. 6, a leaf spring 9 is connected to the friction and detent member 7, whose free end has a substantially semiannular configuration. The bracket 8 is provided with a recess 82, and when the seat-back assembly assumes its upright position, the free end of the leaf spring 9 enters the recess 82 and is retained therein, so that the seat-back assembly is prevented from leaving its upright position.

FIG. 7 shows a different embodiment of the adjusting and arresting mechanism, in which a separate tongue 10 is provided which is attached to the bracket 8 and is provided, at one of its ends, with a semi-annular projection. When the seat-back assembly is moved into its upright position, that is when the seat 1 and the bracket 8 move toward the right in the drawings, the projection of the tongue 10 enters the passage 71 and deforms the walls bounding this passage, thus arresting the seat-back assembly in its upright position.

In the embodiment illustrated in FIG. 8, the seat-back assembly is retained in its upright position in such a manner that a recess 82 is provided in the forward end portion of the bracket 8, and that a biconvex rubber or synthetic plastic body 11 is accommodated in the recess 82 and attached to the bracket 8. During the movement of the seat-back assembly into its upright position, the bracket 8 moves toward the right as seen in the drawing until the body 11 enters the passage 71 of the friction and detent member 7 and the bracket 8 and thus the seat-back assembly is arrested in this position due to the friction between the body 11 and the surfaces bounding the passage 71 of the member 7.

Figure 9:
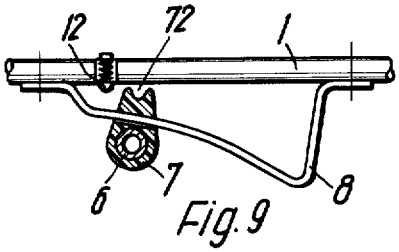

In the embodiment illustrated in FIG. 9, the friction and detent member 7 is provided on its upper side with a recess 72. In addition thereto, a ball-shaped pin 12 is mounted in a vertical bore provided in the seat 1 and biased in the downward direction as shown in the drawing. When the seat 1 is moved toward the right, that is into the upright position of the seat-back assembly, the pin 12 enters the recess 72 and prevents movement of the seat-back assembly out of its upright position until sufficient force is exerted on the seat 1 to overcome the resilient deformation of the member 7 and/or the biasing force acting upon the ball-shaped pin 12.

Figure 10:
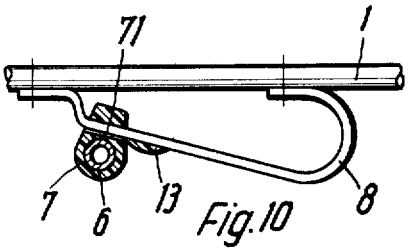

In the embodiment of FIG. 10, a flat, convexly configurated body 13 of rubber or synthetic plastic material is attached to the lower surface of the bracket 8. Here, the body 13 is located to the other side of the friction and detent member 7 than the bodies or tongues of the other embodiments. The dimensions of the body 13 are such as to permit passage of the body 13 through the passage 71 of the member 7 after overcoming the friction between the surfaces bounding the passage 71 of the member 7 and the surface of the body 13. So, when the seat 1 and the associated bracket 8 are moved to the right due to the movement of the seat-back assembly into the upright position thereof, the body 13 enters into and passes through the passage 71 of the member 7 until it emerges on the other side thereof, that is it assumes the illustrated position. Once this happens, the seat-back assembly can be displaced out of its upright position only by overcoming the friction force between the member 7 and the body 13.

Figure 11:
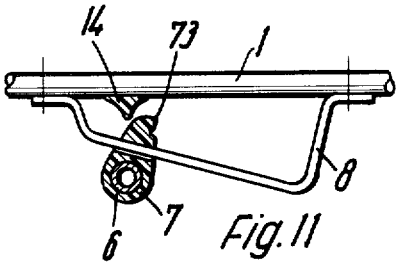

According to the embodiment illustrated in FIG. 11, the friction and detent member 7 is provided on its upwardly directed side with a rib 73, and a member 14 is attached to the lower side of the seat 1 and has a portion which contacts the rib 73 of the member 7 as the seat 1 moves to the right, that is in the direction of the upright position of the seat-back assembly, or vice versa. Thus, when the seat 1 moves to right, shortly before the upright position of the seat-back assembly is reached, the projecting portion of the member 14 contacts the rib 73 and further movement is only possible when one or both of the projecting portions of the member 14 and rib 73 of the member 7 are deflected so as to permit the passage of the member 14 beyond the member 7. Once in this position, that is in the upright position of the seat-back assembly, a sufficient force is needed to again deflect one or both of the projecting portions of the members 14 and 7, respectively. Thus, the seat-back assembly is effectively arrested in its upright position. It is also possible, by appropriately shaping and dimensioning the projecting portions of the member 14 and 7, as illustrated in FIG. 11 to achieve a situation in which larger force is needed for overcoming the force of deflection when the seat 1 moves in one direction than in the opposite direction.

Figure 12:
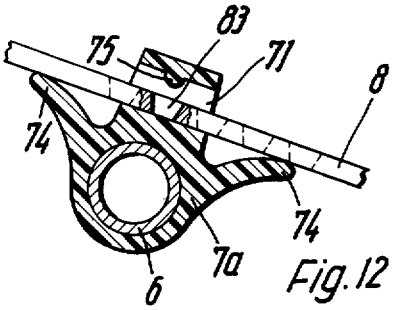
Figure 13:
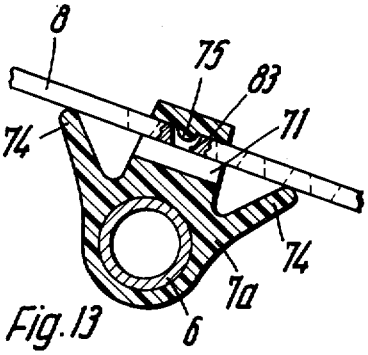

A further embodiment of the adjusting and arresting mechanism according to the invention is shown in FIGS. 12 and 13. The friction and detent member 7a of this embodiment is provided with two elastic projections 74 which are located mirror-symmetrically to the two sides of the member 7. A projection 75 is provided in the passage 71 of the member 7 approximately midway of the two opposite sides of the member 7. The bracket 8 of this embodiment is provided with a succession of holes 83. When the deck-chair is unoccupied, the projections 74 force the bracket 8 upwardly, so that the projection 75 enters a selected one of the successive holes 83 corresponding to the instantaneous position of the seat-back assembly. However, once the seat is occupied, the weight of the occupant forces the seat 1 and thus the bracket 8 downwardly, so that the projection 75 emerges out of the respective hole 83 and the projections 74 are elastically deformed. Thus, when the seat is occupied, the only force retarding or preventing the movement of the seat-back assembly is the friction force between the bracket 8 and the contacting surfaces bounding the passage 71 and of the projections 74, any action of the projection 75 being discontinued. Thus, the force which is necessary to bring about the movement of the seat-back assembly is always the same regardless of the instantaneous position of the seat-back assembly, while in the other embodiments a larger force is needed for bringing the seat-back assembly out of its upright position, while a smaller force is needed for moving the seat-back assembly between an intermediate and fully reclined position or between two intermediate positions. It is to be pointed out that, when the projection 75 and the respective hole 83 are perfectly aligned, the projection 75 enters the hole 83 immediately upon the occupant's leaving the chair, while only a slight movement of the seat-back assembly is necessary for the projection 75 to enter the hole 83 when the projection 75 is not aligned with any of the holes 83, due to the relatively small distance between any two adjacent holes 83. This is further aided by the fact that the holes 83 may diverge in the upward direction of the bracket 8. Herein, FIG. 12 shows the mechanism in the position it assumes when the deck-chair is occupied or when force is exerted on the seat 1, while FIG. 13 shows the same mechanism in its arresting position. It is evident that in this embodiment the seat-back assembly may be arrested in any desired position, not only in the upright position thereof.

Still another embodiment of the adjusting and arresting mechanism according to the invention is illustrated in FIG. 14. In this embodiment a simple upper roller **7*b* of rubber or elastic synthetic plastic material and a similar lower roller 7*c* are rotatably supported on the cross-bar 6 of the frame of the deck-chair, and serve as support rollers for the seat 1, particularly for the seat supporting structure. A wave-shaped bracket 8*b* of flat steel strip material is connected to the seat 1 and is situated downwardly of the roller 7*b* and thus of the cross-bar 6. In this manner, the cross-bar 6 and the roller 7*b* rotatably supported thereon are prevented from leaving the region defined by the seat 1 and the bracket 8*b*. The forward —in the drawing the left— portion of the bracket 8*b* extends in parallelism with the seat 1 and has a distance therefrom which is smaller than the diameter of the roller 7*b*. When the seat and the bracket are moved to the right in the drawing, that is in the rearward direction of the deck-chair —which movement ensues when the seat-back assembly is moved into its upright position, the roller 7*b* enters the relatively narrow gap between the bracket 8*b* and the seat 1,** whose dimension is smaller than the outer diameter of the roller 7*b*, so that the roller 7*b* is deformed causing a marked increase in the frictional force between the roller 7*b* and the surfaces of the elements 8*b* and 1 bounding the gap. Thus, the seat-back assembly is securely retained in its upward position until sufficient force is exerted upon the same to overcome this frictional force. Moreover, the wave-shaped configuration of the bracket 8*b* cooperating with the rollers 7*b* and 7*c* renders possible to hold the seat-back assembly in a plurality of intermediate positions, should this be necessary or desired.

It is to be understood that while only one adjusting and arresting mechanism has been described, it will be advantageous to arrange one such mechanism to each side of the deck-chair, that is in its region adjacent to the lateral portions 5 of the frame. This expedient provides for a better distribution of forces and stresses and improves the overall stability and operation of the deck-chair.

The aforementioned adjusting and arresting mechanism is also suitable for utilization in other types of chairs. So, for instance, FIGS. 15 and 16 show a different deck-chair in which the mechanism can find useful application. The deck-chair according to this embodiment of the invention is collapsible, that is it may be folded if so desired in order to reduce the amount of space taken up by the deck-chair for the purposes of storage, transportation or the like. The lateral portions of the frame of this deck-chair consist of two sections 15 and 16 each or, alternatively, as shown in the drawings, the two corresponding sections 15, preferably of tubular cross-section, and the two corresponding sections 16 are connected by, or made in one piece with, transverse bars so that each of the sections 15 and 16, respectively, has an approximately U-shaped configuration. The sections 15 and 16 are pivotably interconnected by a through pin or two separate pins 17 to each side of the deck-chair. Preferably, the sections 15 and 16 are curved. A connecting section 18 is pivotably connected to the section 16 by the pivot 4 which also pivotably connects the seat-back assembly to the section 16. A cushion —shown in dash-dotted lines— may be provided on and attached to the seat-back assembly 1 to 3, and similarly represented arm rest may be attached to the connecting section 18 in any conventional manner.

The connecting section 18 is so configurated that, when the deck-chair is in its position illustrated in FIG. 15, that is in the assembled position, the free end of the connecting portion bluntly abuts the free end of the section 15. Preferably, these bluntly abutting ends of the sections 15 and 18 are rigidly but dismountably interconnected by means of a spreading device.

Figure 17:
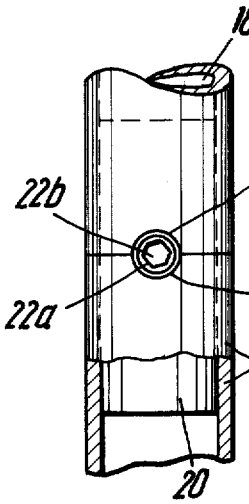
FIG. 17 is a view of the detail A of FIG. 15 on an enlarged scale.
Figure 18:
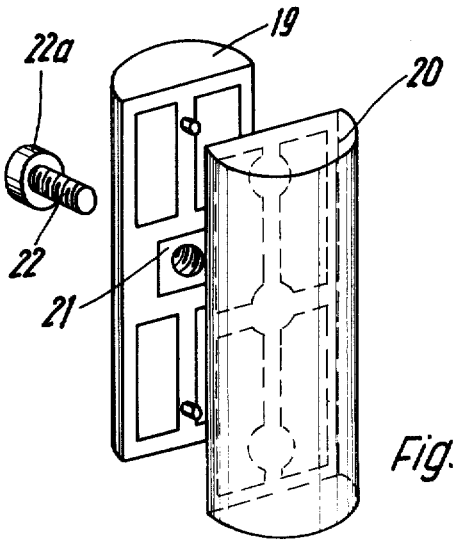
FIG. 18 is an exploded view of a spreading-type device to be used for connecting two distinct parts of the lateral portions of the frame of the deck-chair illustrated in FIGS. 15 to 17.

A spreading device which is particularly suitable for the present purpose is illustrated in FIGS. 17 and 18, and comprises two spreading elements 19 and 20 of substantially semi-cylindrical configuration, which may be of metallic or synthetic plastic material. An internal thread 21 is provided in the spreading element 19 centrally thereof, and is adapted for accepting a screw 22 which is accessible from the exterior of the deck-chair. Preferably, the head 22*a* of the screw 22 is provided with a hexagonal recess 22*b* for accepting a tightening tool. The bluntly abutting ends of the sections 15 and 18 are provided with semi-circular cutouts 23 and 24 for permitting unobstructed passage of the stem of the screw 22 therethrough.

When the deck-chair is to be assembled, it is merely necessary to insert the spreading elements 19 and 20 into the tubular end portions of the sections 15 and 18 in such a manner that the head 22*a* of the screw 22 is accommodated in the cutouts 23 and 24. Subsequently thereto, the screw 22 is tightened, that is rotated in such a sense that the free end of the screw 22 abuts against the element 20 and thus spreads the elements 19 and 20 apart until sufficient friction force is achieved between the outer surfaces of the spreading elements 19 and 20 and the inner surfaces of the tubular end portions of the sections 15 and 18 to prevent unintentional dislodging of the spreading device or disassembly of the connection formed thereby. The advantage of this particular connecting arrangement is that when the deck-chair is assembled, only the relatively small heads 22*a* of the screws 22 are visible and accessible from the outside of the deck-chair, so that the appearance of the latter is not impaired.

When the deck-chair is to be folded, that is when it is to be brought into the position illustrated in FIG. 16, it is only necessary to slightly loosen the screws 22 so as to eliminate the friction between the spreading elements 19 and 20 and the end portions of the sections 15 and 18, whereupon the sections 15 and 18 are taken apart and the deck-chair folded so that the space requirement for storing and/or transporting the deck-chair is significantly reduced.

It is to be understood that in all other respects the deck-chair according to the second embodiment thereof is similar to the first embodiment of the deck-chair, including the possibility to move the seat-back assembly between the upright and the reclined positions thereof and to arrest the same in the former position.

The deck-chair of the present invention is particularly suitable for campoing purposes because of the wide range of application thereof. It is to be noted that this deck-chair can be easily adapted to serve as a cot or foldable bed by the simple expedient of providing conventional means for arresting the seat-back assembly in its fully reclined position.

It will be understood that each of the elments described above, or two or more together, may also find a useful application in other types of furniture or garden equipment differing from the types described above.

While the invention has been illustrated and described as embodied in a deck-chair, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An adjustable deck-chair, comprising a frame having an elongated cross-bar; a seat-back assembly including a back pivoted on said frame and a seat pivotably connected to said back; and supporting means for supporting said seat on said cross-bar for movement between a forward and a retracted position, said supporting means including a friction and detent member pivotably mounted on said cross-bar for angular displacement about the same and having a passage extending transversely of the elongation of said cross-bar and offset therefrom, and a bracket connected to said seat underneath the same and slidably received in said passage in frictional contact with the surface bounding said passage for arresting of said seat in and intermediate said positions thereof.

2. A deck-chair as defined in claim 1, wherein said back is pivoted on said frame for movement between an upright orientation assumed when said seat is in said retracted position, and a substantially horizontal orientation assumed when said seat is in said forward position.

3. A deck-chair as defined in claim 1, wherein said seat has a rear end pivotably connected to said back, said bracket extending in the front-rear direction of said seat; and wherein said bracket is provided in the region of its forward end with a tongue emerging out of the bracket so as to form a wedge therewith, and received in said passage when said seat is in its retracted position to arrest said seat in such position.

4. A deck-chair as defined in claim 1, wherein said frame includes a pair of lateral portions interconnected by said cross-bar; and wherein each of said lateral portions includes a plurality of interconnected sections.

5. A deck-chair as defined in claim 1, wherein said friction and detent member is of elastic material.

6. A deck-chair as defined in claim 1, wherein said seat has a rear end pivotably connected to said back; and wherein said bracket encloses with said seat an acute angle diverging in the rearward direction thereof.

7. A deck-chair as defined in claim 3, wherein said wedge formed by said bracket and said tongue diverges in the forward direction of said bracket.

8. A deck-chair as defined in claim 1, further comprising a leaf spring attached to said friction and detent member and having a substantially semi-annular free end portion emerging out of said friction and detent member; and wherein said bracket is provided with a recess adapted to accept said free end portion of said leaf spring when said seat is in its retracted position.

9. A deck-chair as defined in claim 1, wherein said bracket is provided with an enlarged portion which at least partially enters said passage when said seat approaches said retracted position thereof.

10. A deck-chair as defined in claim 9, wherein said enlarged portion is a spring attached to said bracket.

11. A deck-chair as defined in claim 9, wherein said bracket is provided with a recess adapted to accept a biconvex resiliently yieldable element forming said enlarged portion of said bracket.

12. A deck-chair as defined in claim 9, wherein said enlarged portion is formed by a flat convex element of resiliently yieldable material attached to said bracket. retracted

13. A deck-chair as defined in claim 1, said friction and detent member having an upper side provided with a recess; and further comprising a ball-shaped pin biased in the downward direction of said seat and adapted to be accepted in said recess when said seat is in said reatracted position thereof.

14. A deck-chair as defined in claim 1, further comprising a retaining member attached to said seat and having a projection extending downwardly and moving in a path as said seat moves between said positions thereof; and wherein said friction and detent member has an upwardly directed side provided with a rib extending into said path.

15. A deck-chair as defined in claim 1, wherein said bracket has a forward end portion extending parallel to said seat at a predetermined distance; and wherein said friction and detent member is a roller having a diameter larger than said predetermined distance and accepted between said forward end portion and said seat when said seat is in its retracted position.

16. A deck-chair as defined in claim 15, said bracket having a wave-shaped configuration.

17. A deck-chair as defined in claim 4, wherein each of said lateral portions includes an arm-rest section and two pivotably interconnected support sections, said arm-rest section being pivotably attached to one of said support sections and dismountably connected to the other support section.

18. A deck-chair as defined in claim 17, said arm-rest section having a first free end and said other support section having a second free end, each of said free ends being provided with a cylindrical cavity and having end faces adapted to bluntly abut one another; and further comprising a spreading device inserted into said cylindrical cavities and comprising two spreadable portions frictionally engaging the surfaces bounding said cavities and preventing mutual displacement of said free ends upon spreading of said portions of said spreading device.

19. An adjustable deck-chair, comprising a seat-back assembly including a seat and a back pivotably connected to one another; a frame including a first and a second support section, two arm-rest sections and a cross-bar connecting two laterally spaced portions of said first support section; a pivot pivotably connecting said back to said second support section and said arm-rest sections to said second support section, said back and said arm-rest sections being movable independently of one another; adjusting means connecting said seat to said cross-bar with freedom of movement in a limited range; and a spreading device connecting the respective one of said arm rest sections to the associated lateral portion of said first support section.

* * * * *